US005368298A

United States Patent [19]

You

[11] Patent Number: 5,368,298

[45] Date of Patent: Nov. 29, 1994

[54] GAME RACKET OF COMPOSITE MATERIAL

[76] Inventor: Chin-San You, No. 6, Lane 477, Sec. 2, Heng-Shyn Rd., Feng Yuan City, Taichung Hsien, Taiwan, Prov. of China

[21] Appl. No.: 178,815

[22] Filed: Jan. 7, 1994

[51] Int. Cl.[5] ..... A63B 49/10

[52] U.S. Cl. ..... 273/73 R; 273/73 J; 273/73 F

[58] Field of Search ..... 273/73 R, 73 C, 73 F, 273/738, 75, DIG. 23

[56] References Cited

U.S. PATENT DOCUMENTS

| | | | |
|---|---|---|---|
| 4,429,873 | 2/1984 | Van Radondonck | 273/73 F |
| 4,725,059 | 2/1988 | DuGardin et al. | 273/738 X |
| 5,071,125 | 12/1991 | Shen | 273/738 X |
| 5,135,223 | 8/1992 | You | 273/738 |
| 5,242,724 | 9/1993 | You | 273/738 X |
| 5,273,279 | 12/1993 | You | 273/73 F |

*Primary Examiner*—Vincent Millin
*Assistant Examiner*—Raleigh W. Chiu
*Attorney, Agent, or Firm*—Browdy and Neimark

[57] ABSTRACT

A game racket of composite material comprises a head, a shaft and a handle. The head and the shaft are made of a tubular body while the handle is made of a second tubular body and a third tubular body. The second tubular body extends posteriorly form one end of the first tubular body and is covered with the third tubular body. The first and the second tubular bodies are composed respectively of a first and a second outer shells of a plastic composite material containing long fiber reinforced thermosetting resin. The second outer shell has fewer layers than the first outer shell. The third tubular body has a third outer shell of a plastic composite material containing fiber reinforced thermosetting resin. The second outer shell is covered with the third outer shell.

8 Claims, 3 Drawing Sheets

GAME RACKET OF COMPOSITE MATERIAL

FIELD OF THE INVENTION

The present invention relates generally to a game racket, and more particularly to an improved game racket of composite material.

BACKGROUND OF THE INVENTION

The conventional game racket of composite material is composed of a head, a shaft and a handle, which are made of a laminated tubular shell body by bending. The laminated tubular shell body is made by winding from a plurality of superimposed layers of long fiber sheets preimpregnated with thermosetting resin. As a result, the head, the shaft and the handle of the conventional game racket described above are made integrally and are similar in construction. Such a uniformity in construction makes the conventional game racket of composite material undesirable in view of the fact that the shock wave generated in the head by the impact of a ball is easily transmitted to the shaft and then to the handle without interruption. It is therefore readily apparent that such a conventional game racket of composite material as described above can inflict an injury on the hand of a player.

With a view to finding a solution to the problem described above, the Taiwanese Patent Serial Number 81201373 and the U.S. Pat. No. 5,071,125 disclose respectively a game racket frame made up of two independent portions of different materials. One of the two independent portions is used to make up the head and the shaft of the game racket while another one of the two independent portions makes up the handle of the game racket. As a result, the transmission of the shock wave generated in the head by the impact of a ball is interrupted at the junction between the two independent portions, thereby mitigating the risk that the hand of a player is hurt by the shock wave. However, such a prior art game racket disclosed respectively in the above-mentioned patent documents is defective in design in that structural integrity and rigidity of the game racket are undermined, and that the junction between the two independent portions making up the game racket is highly vulnerable to breakage caused by the concentration of stress at the junction.

SUMMARY OF THE INVENTION

It is therefore the primary objective of the present invention to provide an improved game racket of composite material, which is so structurally rigid as to avert the breakage of the game racket and is capable of attenuating effectively the shock wave transmitted from the head to the handle of the game racket.

The foregoing objective of the present invention is attained by the improved game racket of composite material, which comprises a first tubular body, a second tubular body, and a third tubular body. The first tubular body makes up a head and a shaft of the game racket. The second tubular body extends downwards from one end of the shaft. The third tubular body is used to cover the second tubular body. In other words, the handle of the game racket of the present invention is made up of the second and the third tubular bodies. The first tubular body is made of a plastic composite material containing a thermosetting resin reinforced by long fibers and is composed of a first outer shell having a predetermined number of superimposed layers. The second tubular body is made of a plastic composite material containing a thermosetting resin reinforced by long fibers and is composed of a second outer shell having a predetermined number of superimposed layers. The number of the superimposed layers of the second outer shell is smaller than that of the superimposed layers of the first outer shell. The third tubular body comprises a third outer shell made of a plastic material containing a thermosetting resin reinforced by long fibers. The third outer shell is adhered to the surface of the second outer shell.

As described previously, the head and the shaft of the game racket of composite material of the present invention is made up of the first tubular body while the handle of the game racket of the present invention is made up of the second tubular body extending from the first outer shell of the first tubular body and of the third tubular body covering the second tubular body. As a result, a shock wave transmitting from the head to the handle via the shaft is partially intercepted at the junction of the first and the second tubular bodies. In addition, the shock wave is partly absorbed by the third tubular body. As a result, the magnitude of the shock wave reaching the handle of the game racket of the present invention is so reduced that the hand of a player is not vulnerable to injuries. Moreover, structural integrity and rigidity of the game racket of the present invention are by no means compromised in view of the fact that the handle of the game racket of the present invention is in itself a structural extension of the shaft.

DETAILED DESCRIPTION OF THE INVENTION

Figure 1:
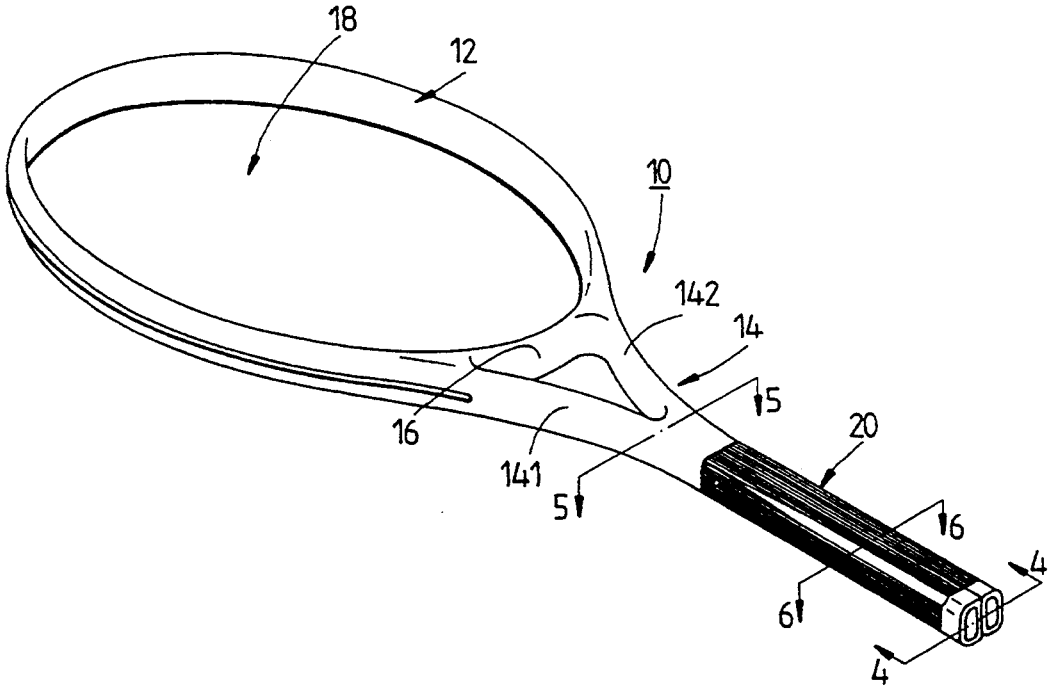
FIG. 1 shows a perspective view of a preferred embodiment of the present invention.
Figure 2:
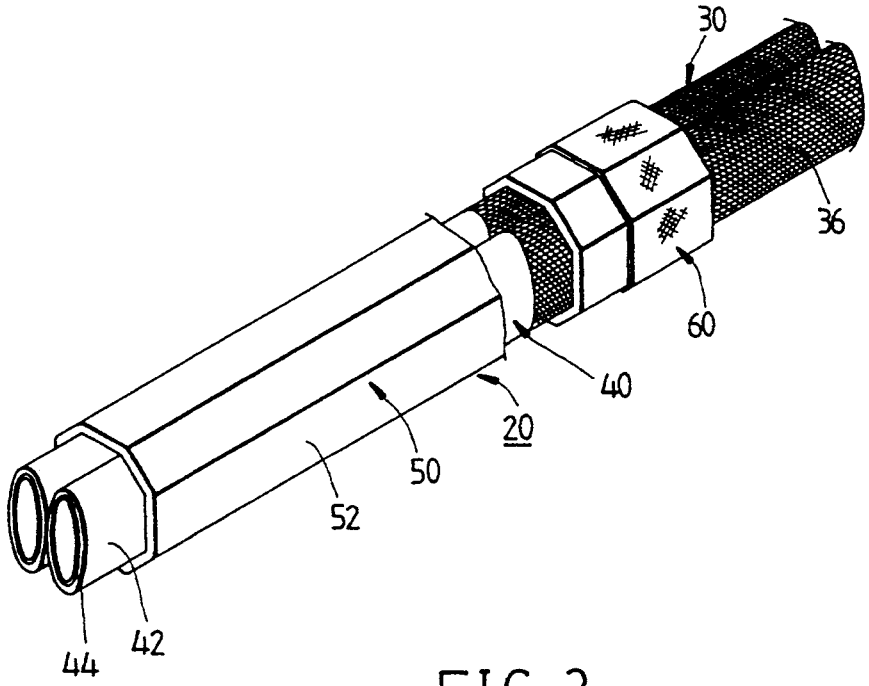
FIG. 2 shows a partial sectional view of the preferred embodiment of the present invention.

Referring to all drawings provided herewith, a game racket frame 10 embodied in the present invention is shown to comprise a circular head 12, a shaft 14 having two branches 141 and 142 which are connected respectively with two open ends of the circular head 12, a jaw 16 bridging the two open ends of the circular head 12 to define in conjunction with the circular head 12 a ball striking area 18, and a handle 20 extending posteriorly from the merging end of the two branches 141 and 142.

The circular head 12 and the shaft 14 are formed of a first tubular body 30 having a first outer shell 36 which is formed by winding in sequence five to seven layers of carbon fiber sheets 32 impregnated with epoxy resin and two to three layers of glass fiber sheets 34 impregnated with epoxy resin. In addition, the first tubular body 30 has a thin plastic wind pipe 38 fitted into the first outer shell 36.

Figure 3:
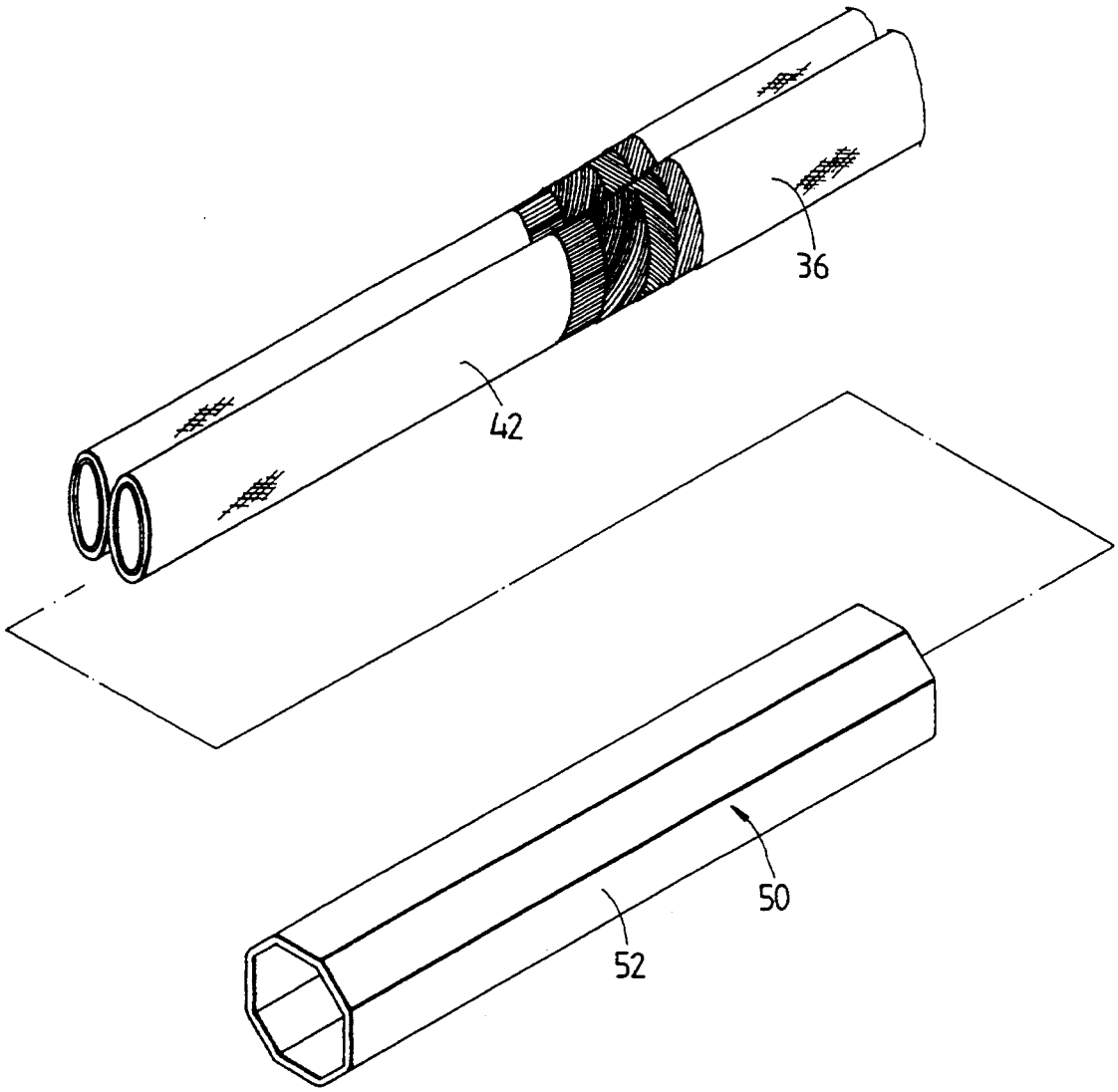
FIG. 3 shows a partial exploded view of the preferred embodiment of the present invention.
Figure 4:
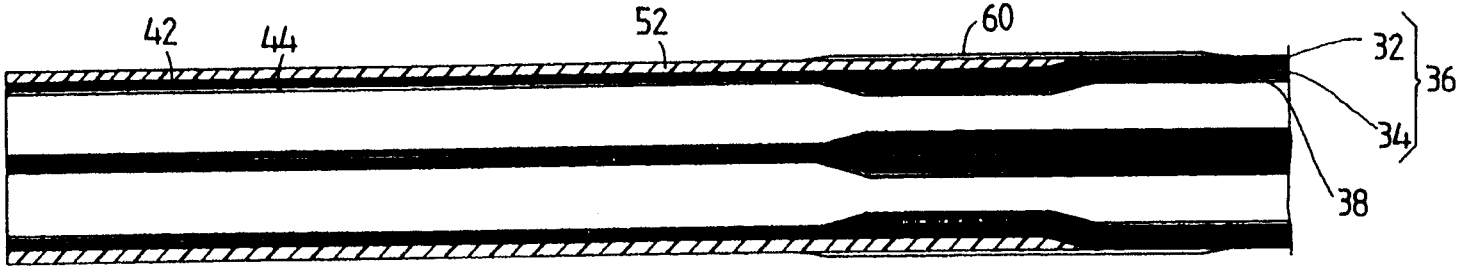
FIG. 4 shows a sectional view taken along the line 4—4 as shown in FIG. 1.
Figure 6:
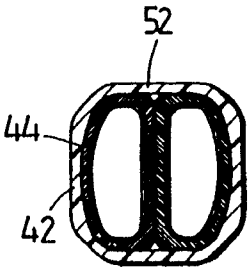
FIG. 6 shows a sectional view taken along the line 6—6 as shown in FIG. 1.
Figure 5:
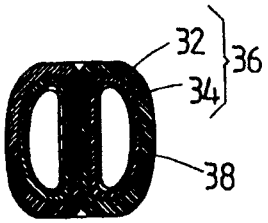
FIG. 5 shows a sectional view taken along the line 5—5 as shown in FIG. 1.

The handle 20 is formed of a second tubular body 40 and a third tubular body 50. The second tubular body 40 has a second outer shell 42 which is formed by extending the glass fiber sheets 34 of the first outer shell 36. In addition, the second tubular body 40 has a thin plastic wind pipe 44 which is formed by extending the first thin plastic wind pipe 38. The number of layers in the neighboring portion of the first outer shell 36 and the second outer shell 42 should be reduced sequentially, as shown in FIG. 3, to avert the concentration of stress- The third tubular body 50 has a third outer shell 52 made of superimposed layers of carbon fiber sheets impregnated with nylon by winding. The third outer shell 52 may be also made of a plastic composite material containing short carbon fibers and nylon resin by molding.

In the process of making the game racket frame 10 of the present invention, the third tubular body 50 is formed first. The unhardened and unformed second outer shell 42 is covered with the third tubular body 50 such that the anterior end of the third tubular body 50 is superimposed on the posterior end of the first outer shell 36. Thereafter, the junction of the first and the second outer shells 36 and 42 is covered with two to three layers of carbon fiber sheets impregnated with epoxy resin so as to form a reinforcing layer 60. The first tubular body 30, the second tubular body 40, the third tubular body 50 and the reinforcing layer 60 are arranged in a molding tool in which they are shaped under heat and pressure into the game racket frame 10 of the present invention. It is suggested that the posterior end of the second tubular body 40 is extended beyond the posterior end of the third tubular body 50 for fastening thereto an air valve for use in injecting a high pressure air.

The carbon fiber and the glass fiber mentioned above may be replaced by any reinforcing fiber, such as Kevlar fiber, boron fiber, or ceramic fiber. The thermosetting resin used to make the third outer shell 52 of the present invention may be replaced by nylon 6, nylon 6/6, nylon 11, nylon 12, polyester, polypropylene, or acrylic butadiene styrene polymer.

What is claimed is:

1. A game racket of composite material comprising a head, a shaft and a handle; wherein said head and said shaft are made of a first tubular body; wherein said handle is made of a second tubular body and a third tubular body, said second tubular body extending posteriorly from one end of said first tubular body, said second tubular body being covered with said third tubular body; wherein said first tubular body comprises a predetermined layers of a first outer shell of a plastic composite material containing a thermosetting resin reinforced by long fibers; wherein said second tubular body comprises a predetermined layers of a second outer shell of a plastic composite material containing a thermosetting resin reinforced by long fibers, said layers of said second outer shell being less than said layers of said first outer shell; and wherein said third tubular body comprises a third outer shell of a plastic composite material containing a thermosetting resin reinforced by fibers, said third outer shell covering said second outer shell.

2. The game racket of claim 1 wherein said second outer shell is formed of a posterior extension of portion of inner layers of said first outer shell.

3. The game racket of claim 2 wherein said first outer shell and said second outer shell form a junction in which the number of layers is reduced progressively in the direction toward said second outer shell.

4. The game racket of claim 2 wherein said third outer shell has an anterior end connecting with a posterior end of said first outer shell.

5. The game racket of claim 4 wherein said anterior end of said third outer shell is fitted over said posterior end of said first outer shell.

6. The game racket of claim 4 wherein said third outer shell and said first outer shell form a junction covered with a reinforcing layer formed of a plurality of long fiber sheets which are impregnated with thermosetting resin and are stacked windingly across said junction.

7. The game racket of claim 1 wherein said shaft comprises two branches which are formed by extending respectively two open ends of said head after said head is formed of said first tubular body by bending, said two branches extending posteriorly to merge.

8. The game racket of claim 1 wherein said second tubular body has a posterior end of a predetermined length and extending beyond a posterior end of said tubular body.

* * * * *